US009950547B2

(12) United States Patent
Sasaki et al.

(10) Patent No.: US 9,950,547 B2
(45) Date of Patent: Apr. 24, 2018

(54) THERMAL TRANSFER PRINTER CONFIGURED TO PRINT BY TRANSFERRING INK FROM AN INK RIBBON ONTO A PRINT SURFACE OF A PRINT MEDIUM USING A THERMAL HEAD

(71) Applicant: SATO HOLDINGS KABUSHIKI KAISHA, Tokyo (JP)

(72) Inventors: Shuzo Sasaki, Iwate (JP); Koji Kirita, Iwate (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/308,642

(22) PCT Filed: May 18, 2015

(86) PCT No.: PCT/JP2015/064192

§ 371 (c)(1),
(2) Date: Nov. 3, 2016

(87) PCT Pub. No.: WO2015/182422

PCT Pub. Date: Dec. 3, 2015

(65) Prior Publication Data

US 2017/0182812 A1 Jun. 29, 2017

(30) Foreign Application Priority Data

May 30, 2014 (JP) ..... 2014-112146

(51) Int. Cl.

| | |
|---|---|
| ***B41J 2/325*** | (2006.01) |
| ***B41J 17/04*** | (2006.01) |
| ***B41J 33/16*** | (2006.01) |
| ***B41J 25/304*** | (2006.01) |

(52) U.S. Cl.

CPC ..... *B41J 17/04* (2013.01); *B41J 2/325* (2013.01); *B41J 25/304* (2013.01); *B41J 33/16* (2013.01)

(58) Field of Classification Search

CPC . B41J 17/04; B41J 2/325; B41J 25/304; B41J 33/16

See application file for complete search history.

(56) References Cited

U.S. PATENT DOCUMENTS 4,614,950 A 9/1986 Ito
5,986,683 A * 11/1999 Sawano ..... B41J 35/00 347/171

FOREIGN PATENT DOCUMENTS

| | | | |
|---|---|---|---|
| JP | 59-76282 | A | 5/1984 |
| JP | 60-71281 | A | 4/1985 |
| JP | 61-68274 | A | 4/1986 |
| JP | 10-16365 | A | 1/1998 |
| JP | 2006-334857 | A | 12/2006 |

* cited by examiner

*Primary Examiner* — Bradley Thies
(74) *Attorney, Agent, or Firm* — Foley & Lardner LLP

(57) ABSTRACT

A thermal transfer printer includes a label feeding roller driving unit, a ribbon roll-up driving unit, a ribbon feeding roller, a ribbon feeding roller driving unit, and a controller. The ribbon feeding roller has an adhesive layer on its surface and is rotated to feed the ink ribbon while holding the ink ribbon on the adhesive layer.

7 Claims, 8 Drawing Sheets

THERMAL TRANSFER PRINTER CONFIGURED TO PRINT BY TRANSFERRING INK FROM AN INK RIBBON ONTO A PRINT SURFACE OF A PRINT MEDIUM USING A THERMAL HEAD

TECHNICAL FIELD

The present invention relates to a thermal transfer printer that performs printing by nipping a print medium and an ink ribbon between a platen roller and a thermal head, and more particularly, to a thermal transfer printer in which the ink ribbon is fed using a feeding roller having an adhesive surface.

BACKGROUND ART

In a thermal transfer printer in which ink is transferred from an ink ribbon onto a print medium such as labels by nipping the print medium and the ink ribbon between a thermal head and a platen roller, feeding of the print medium is controlled by driving a feeding mechanism, and feeding of the ink ribbon is controlled by driving a ribbon roll-up roller (for example, see JP 2006-334857 A).

In the thermal transfer printer discussed in JP 2006-334857 A, a plurality of slip mechanisms are provided in an ink ribbon roll-up roller. In this thermal transfer printer, a winding torque can be controlled by selectively activating a plurality of slip mechanisms to obtain a stable winding torque.

SUMMARY OF INVENTION

A mechanism for opening or closing the thermal head is required in the thermal transfer printer discussed in JP 2006-334857 A. Therefore, the ribbon roll-up roller and the ribbon feeding roller are placed far from the thermal head. For this reason, it is difficult to allow the ribbon roll-up roller and the ribbon feeding roller to follow forward and backward feeding operations of the print medium in the feeding mechanism.

In addition, in the thermal transfer printer discussed in JP 2006-334857 A, a winding torque of the ribbon roll-up roller and a winding amount of the ink ribbon are controlled. However, since a diameter of the ink ribbon wound around the ribbon roll-up roller changes, the control of rotation of the ribbon roll-up roller may disadvantageously fail to allow the roll-up amount to follow a change of the winding diameter of the ink ribbon.

Furthermore, in the thermal transfer printer discussed in JP 2006-334857 A, a tension roller for preventing a wrinkle is provided between the thermal head and the ribbon roll-up roller or between the thermal head and the ribbon feeding roller. However, this tension roller is a manual or fixed roller and does not actively dispense or roll up the ink ribbon to or from the thermal head. Therefore, the ink ribbon may be delayed in operation relative to feeding of the print medium in the feeding mechanism. This disadvantageously makes the ink ribbon slip and scrape with the print medium and generates a so-called surface stain.

In a thermal transfer printer having a so-called ribbon save function in which a consumption of the ink ribbon is saved by elevating or lowering the thermal head in a non-print area as discussed in JP 2006-334857 A, the ink ribbon loosened by elevating the thermal head is rolled up by the ribbon roll-up roller. However, the amount of the saved ink ribbon disadvantageously changes depending on the winding diameter of the roll-up roller.

In view of the aforementioned problems, it is therefore an object of the present invention to provide a thermal transfer printer capable of accurately feeding the ink ribbon regardless of a change of the winding diameter of the ink ribbon.

According to a first aspect of the present invention, there is provided a thermal transfer printer configured to print by nipping a print medium fed by a feeding mechanism and an ink ribbon fed from a ribbon feeding unit and rolled up by a ribbon roll-up unit between a platen roller and a thermal head and transferring ink from the ink ribbon onto a print surface of the print medium using the thermal head, the thermal transfer printer includes at least one of a first ribbon feeding roller provided between the thermal head and the ribbon roll-up unit and a second ribbon feeding roller provided between the thermal head and the ribbon feeding unit; a ribbon feeding roller driving unit configured to drive the at least one of the ribbon feeding rollers; and a controller configured to control the ribbon feeding roller driving unit, a driving unit of the feeding mechanism, and a driving unit of the ribbon roll-up unit, wherein the ribbon feeding roller has an adhesive layer on its surface and feeds the ink ribbon be being rotated while holding the ink ribbon on the adhesive layer.

In this aspect described above, the ribbon feeding roller provided in at least one of an interval between the thermal head and the ribbon roll-up unit and an interval between the thermal head and the ribbon feeding unit to feed the ink ribbon has an adhesive layer on its surface. The ribbon feeding roller is rotated to feed the ink ribbon while holding the ink ribbon on the adhesive layer. As a result, it is possible to accurately control a feeding amount of the ink ribbon regardless of a change of the winding diameter of the ink ribbon. Therefore, it is possible to suppress loosening of the ink ribbon and a surface stain or the like that may be generated by a slip of the ink ribbon.

Since the ribbon feeding roller is provided between the thermal head and the ribbon roll-up unit, it is possible to accurately control the amount of the ink ribbon fed toward the ribbon roll-up unit. Therefore, it is possible to suppress loosening of the ink ribbon between the thermal head and the ribbon roll-up unit. In addition, it is possible to prevent a surface stain of the print medium. In addition, since the ribbon feeding roller is provided between the thermal head and the ribbon feeding unit, it is possible to suppress loosening of the ink ribbon when the ink ribbon and the print medium are fed backward to the feeder side. In addition, it is possible to prevent a surface stain.

According to a second aspect of the invention, the thermal transfer printer includes a first ribbon feeding roller provided between the thermal head and the ribbon roll-up unit and a second ribbon feeding roller provided between the thermal head and the ribbon feeding unit and operated in synchronization with the first ribbon feeding roller.

In this aspect described above, the first and second ribbon feeding rollers are provided between the thermal head and the ribbon roll-up unit and between the thermal head and the ribbon feeding unit, respectively. Therefore, it is possible to accurately control the feeding amount of the ink ribbon between the thermal head and the ribbon roll-up unit and between the thermal head and the ribbon feeding unit. Accordingly, it is possible to prevent loosening of the ink ribbon, a surface stain, and the like.

According to a third aspect of the invention, the thermal transfer printer includes a thermal head elevator mechanism configured to elevate or lower the thermal head, and the controller controls a driving unit of the thermal head elevator mechanism.

In this aspect described above, after printing is performed by transferring ink from the ink ribbon onto a print surface of the print medium using the thermal head, the thermal head is elevated using the thermal head elevator mechanism, and the print medium is fed while the feeding of the ink ribbon in the ribbon feeding roller and the ink ribbon roll-up operation in the ribbon roll-up unit stop. Therefore, it is possible to accurately control the amount of the saved ink ribbon.

According to a fourth aspect of the invention, the adhesive layer on the surface of the ribbon feeding roller is formed by providing an adhesive sheet body on a cylindrical roller, and the adhesive sheet body includes a first layer constituted of silicone, a second layer constituted of glass cloth, and a third layer constituted by a silicone adhesive layer.

In this aspect described above, the adhesive layer on the surface of the ribbon feeding roller is formed by providing the adhesive sheet body on the cylindrical roller. Therefore, it is possible to facilitate manufacturing and replacement of the adhesive layer.

According to a fifth aspect of the invention, the adhesive sheet body has a peel adhesion strength of 2.85 N/25 mm or higher and 4.2 N/25 mm or lower at a peel speed of 300 mm/min and a peel angle of 180° under a standard state complying with Japanese Industrial Standard JIS-Z0237.

In this aspect described above, by setting the peel adhesion strength of the sheet body to the aforementioned range, it is possible to feed the ink ribbon using the ribbon feeding roller formed by providing the sheet body on the cylindrical roller while holding the ink ribbon on the adhesive layer.

According to a sixth aspect of the invention, the controller includes a feeding control means configured to start ink ribbon feeding using the first ribbon feeding roller simultaneously with the ink ribbon roll-up operation in the ribbon roll-up unit and then start feeding of the print medium using the feeding mechanism, a print control means configured to print on the print medium by transferring the ink from the ink ribbon using the thermal head, and a stop control means configured to stop feeding of the print medium in the feeding mechanism simultaneously with stopping the feeding of the ink ribbon in the first ribbon feeding roller and then stop the ink ribbon roll-up operation in the ribbon roll-up unit.

In this aspect described above, the feeding of the ink ribbon in the first ribbon feeding roller starts simultaneously with the ink ribbon roll-up operation in the ribbon roll-up unit, and the print medium is then fed. The first ribbon feeding roller is rotated to feed the ink ribbon while holding the ink ribbon on the adhesive layer. Therefore, it is possible to accurately control the feeding amount of the ink ribbon and suppress loosening of the ink ribbon and a surface stain.

In addition, feeding of the print medium in the feeding mechanism stops simultaneously with stopping the ink ribbon feeding. Then, the ink ribbon roll-up operation in the ribbon roll-up unit stops. Therefore, it is possible to suppress loosening of the ink ribbon even after the stop.

According to a seventh aspect of the invention, the controller includes a cutting/peeling control means configured to cut or peel a predetermined portion of the print medium using a print medium cutter or peeler unit, the predetermined portion of the print medium being printed on by transferring the ink from the ink ribbon using the thermal head, a backward feeding control means configured to reduce a roll-up force of the ribbon roll-up unit and feed the ink ribbon toward the ribbon feeding unit using the second ribbon feeding roller after cutting or peeling the print medium and then feed a part of the print medium remaining after cutting or peeling the predetermined portion of the print medium toward a predetermined position opposite to the cutter or peeler unit using the feeding mechanism, and a backward feeding stop control means configured to stop the feeding of the ink ribbon by the second ribbon feeding roller and stop feeding of the print medium by the feeding mechanism when the print medium reaches the predetermined position.

In this aspect described above, the roll-up force of the ribbon roll-up unit is reduced after a printed portion of the print medium is cut or peeled. At the same time, the ink ribbon feeding toward the ribbon feeding unit starts using the second ribbon feeding roller having the adhesive layer on its surface. Then, a part of the print medium remaining after the cutting or peeling is fed using the feeding mechanism to a predetermined position opposite to the cutter or peeler unit. The second ribbon feeding roller is rotated to feed the ink ribbon while holding the ink ribbon on the adhesive layer. Therefore, it is possible to accurately control the feeding amount of the ink ribbon, remove loosening of the ink ribbon in the backward feeding, and suppress a surface stain.

According to an eighth aspect of the present invention, the thermal transfer printer further includes a thermal head elevator mechanism for elevating or lowering the thermal head, wherein the controller includes a feeding control means configured to start the feeding of the ink ribbon in the first ribbon feeding roller simultaneously with the ink ribbon roll-up operation in the ribbon roll-up unit and then start feeding of the print medium in the feeding mechanism, a print control means configured to print on the print medium by transferring the ink from the ink ribbon using the thermal head, an elevation control means configured to control elevation or lowering of the thermal head elevator mechanism, and a ribbon feeding stop control means configured to stop the feeding of the ink ribbon in the first and second ribbon feeding rollers after elevating the thermal head using the elevation control means and then stop the ink ribbon roll-up operation in the ribbon roll-up unit.

In this aspect described above, the thermal head is elevated using the thermal head elevator mechanism after the thermal head performs printing on the print surface of the print medium by transferring ink from the ink ribbon. Then, the print medium is fed while the feeding of the ink ribbon in the ribbon feeding roller and the ink ribbon roll-up operation in the ribbon roll-up unit stop. Therefore, it is possible to accurately control the amount of the saved ink ribbon.

In this aspect described above, the ribbon feeding roller having the adhesive layer on its surface is provided, and the ink ribbon is fed by rotating the ribbon feeding roller while the ink ribbon is held on the adhesive layer. Therefore, it is possible to accurately control the feeding amount of the ink ribbon with high precision regardless of a change of the winding diameter and suppress loosening of the ink ribbon, a surface stain, and the like. In addition, the thermal head is elevated, and the print medium is then fed while the feeding of the ink ribbon in the ribbon feeding roller and the ink ribbon roll-up operation in the ribbon roll-up unit stop. Therefore, it is possible to accurately control the amount of the saved ink ribbon.

DESCRIPTION OF EMBODIMENTS

First Embodiment

A first embodiment of the present invention will now be described with reference to the accompanying drawings.

Figure 1:
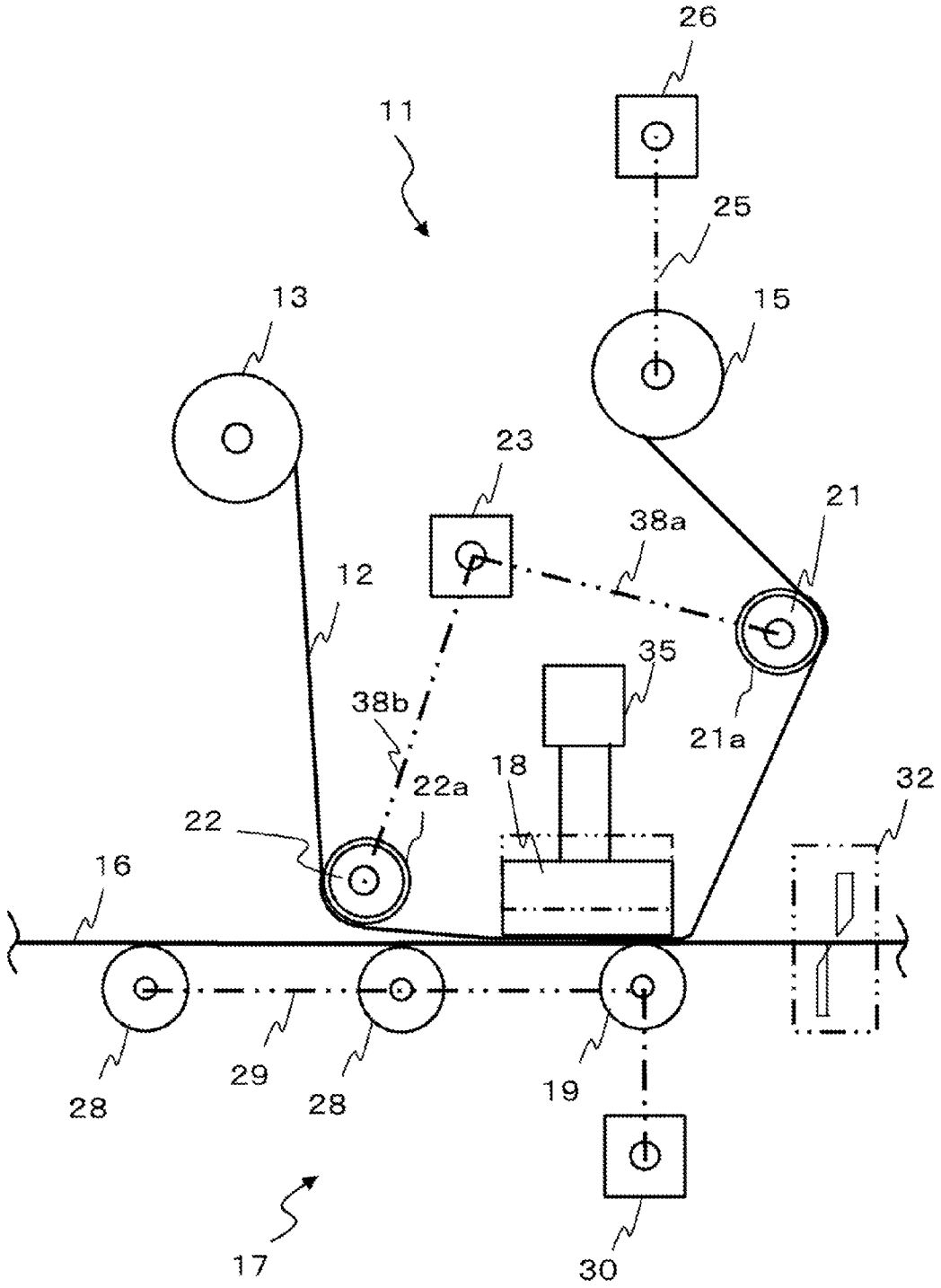
FIG. 1 is a schematic diagram illustrating a thermal transfer printer according to a first embodiment of the invention.

A thermal transfer printer 11 according to the first embodiment of the invention is configured as illustrated in FIG. 1.

The thermal transfer printer 11 includes a ribbon feeding unit 13 configured to feed an ink ribbon 12 wound around a shaft, a ribbon roll-up unit 15 configured to roll up the ink ribbon 12 subjected to thermal transfer printing around a shaft, a feeding mechanism 17 configured to feed a continuous label sheet 16 as a print medium of the thermal transfer printing, a thermal head 18 and a platen roller 19 configured to perform thermal transfer printing by nipping the continuous label sheet 16 and the ink ribbon 12 while they are fed, a first ribbon feeding roller 21 provided between the thermal head 18 and the ribbon roll-up unit 15 to feed the ink ribbon 12, a second ribbon feeding roller 22 provided between the thermal head 18 and the ribbon feeding unit 13 to feed the ink ribbon 12, and a ribbon feeding roller driving unit 23 configured to drive the first ribbon feeding roller 21 and a second ribbon feeding roller 22 in synchronization with each other.

In the ribbon feeding unit 13, an unexpended ink ribbon 12 is wound around a shaft. The ribbon feeding unit 13 feeds the unexpended ink ribbon 12 by extracting the ink ribbon 12 through a roll-up operation of the ribbon roll-up unit 15.

The ribbon feeding unit 13 exerts a tensile force oppositely to a direction of the roll-up force to the ink ribbon 12 at all times to prevent loosening of the ink ribbon 12 during feeding of the ink ribbon 12. In addition, the ribbon feeding unit 13 is provided with a torque limiter (not shown) configured to release or reduce a torque caused by the roll-up force when the torque reaches a predetermined value or higher.

The ribbon roll-up unit 15 is connected to a ribbon roll-up driving unit 26. The ribbon roll-up driving unit 26 drives the ribbon roll-up unit 15 using a power transmission unit 25 provided with a belt or the like. The ribbon roll-up unit 15 rolls up the expended ink ribbon 12 in the shaft of the core side. The ribbon roll-up unit 15 is provided with a torque limiter (not shown) configured to control (reduce or release) a torque when a predetermined torque or higher is generated in the ribbon roll-up unit 15 at the time of the winding.

The feeding mechanism 17 includes a platen roller 19, a plurality of label feeding rollers 28 arranged approximately coplanar with the platen roller 19, a power transmission unit 29 provided with a belt or the like, and a label feeding roller driving unit 30 configured to rotatably drive the platen roller 19 and the label feeding roller 28 through the power transmission unit 29. The continuous label sheet 16 is placed on the label feeding roller 28 and the platen roller 19 and fed.

The continuous label sheet 16 is obtained by temporarily attaching a plurality of label pieces on a band-shaped liner sheet at a predetermined interval. A print position on the continuous label sheet 16 is controlled by detecting a position detection mark (not shown) provided on the label piece or the liner sheet using a detection sensor 51 (refer to FIG. 2). In the downstream of the continuous label sheet 16 in the feeding direction, a cutter unit 32 for cutting the printed label piece and the liner sheet is provided. Note that the printed label piece may also be peeled from the liner sheet. In this case, a peeler unit is provided instead of the cutter unit 32.

The thermal head 18 performs printing while the continuous label sheet 16 placed on the platen roller 19 and the ink ribbon 12 placed on the continuous label sheet 16 are nipped between the platen roller 19 and the thermal head 18. A printing portion of the thermal head 18 is an assembly of minute heating elements that emits heat by receiving an electric current.

The thermal head 18 transfers a part of the ink from the ink ribbon 12 to a label print surface of the continuous label sheet 16 placed on the platen roller 19 by selectively activating the heating elements to print desired characters, symbols, or the like.

The thermal transfer printer 11 is provided with a thermal head elevator 35 configured to vertically elevate or lower the thermal head 18. The thermal head elevator 35 elevates the thermal head 18 when a predetermined continuous length of the non-print portion exists in the continuous label sheet 16 (in the position indicated by the dotted chain line in FIG. 1) and stops feeding of the ink ribbon 12 in order to suppress useless consumption of the ink ribbon 12 (ink ribbon save function).

The first ribbon feeding roller 21 is provided in the downstream side of the thermal head 18 (platen roller 19) in the feeding direction of the ink ribbon 12, that is, between the thermal head 18 (platen roller 19) and the ribbon roll-up unit 15. The second ribbon feeding roller 22 is provided in the upstream side of the thermal head 18 (platen roller 19) in the feeding direction of the ink ribbon 12, that is, between the thermal head 18 (platen roller 19) and the ribbon feeding unit 13.

The first and second ribbon feeding rollers 21 and 22 (simply referred to as ribbon feeding rollers 21 and 22) are connected to the ribbon feeding roller driving unit 23. The ribbon feeding roller driving unit 23 drives the ribbon feeding rollers 21 and 22 through power transmission units 38*a* and 38*b* provided with a belt or the like in synchronization with each other.

The ribbon feeding rollers 21 and 22 are provided with adhesive layers 21*a* and 22*a*, respectively, on their surfaces. The ribbon feeding rollers 21 and 22 are rotated to feed the ink ribbon 12 while the ink ribbon 12 is held on the adhesive layers 21*a* and 22*a*.

A feeding speed of the ribbon feeding rollers 21 and 22 for feeding the ink ribbon 12 is set to be approximately the same as a circumferential speed of the ribbon feeding rollers 21 and 22. The ribbon feeding rollers 21 and 22 are formed by pasting up an adhesive sheet body including a first layer constituted of silicone serving as an outer surface, a second layer constituted of glass cloth, and a third layer constituted of a silicone adhesive around a cylindrical roller.

The adhesive sheet body has a peel adhesion strength of 2.85 N/25 mm or higher and 4.2 N/25 mm or lower at a peel speed of 300 mm/min and a peel angle of 180° under a standard state complying with Japanese Industrial Standard JIS-Z0237. If a sheet body complying with this standard is employed, it is possible to feed the ink ribbon 12 by rotating the ribbon feeding rollers 21 and 22 while the ink ribbon 12 is held on the adhesive layers 21*a* and 22*a* on the surfaces of the ribbon feeding rollers 21 and 22.

The ribbon feeding roller driving unit 23, the ribbon roll-up driving unit 26, the label feeding roller driving unit 30, the thermal head elevator 35, and the cutter unit 32 are communicatably connected to a controller 50 (refer to FIG. 2) that controls these components.

Figure 2:
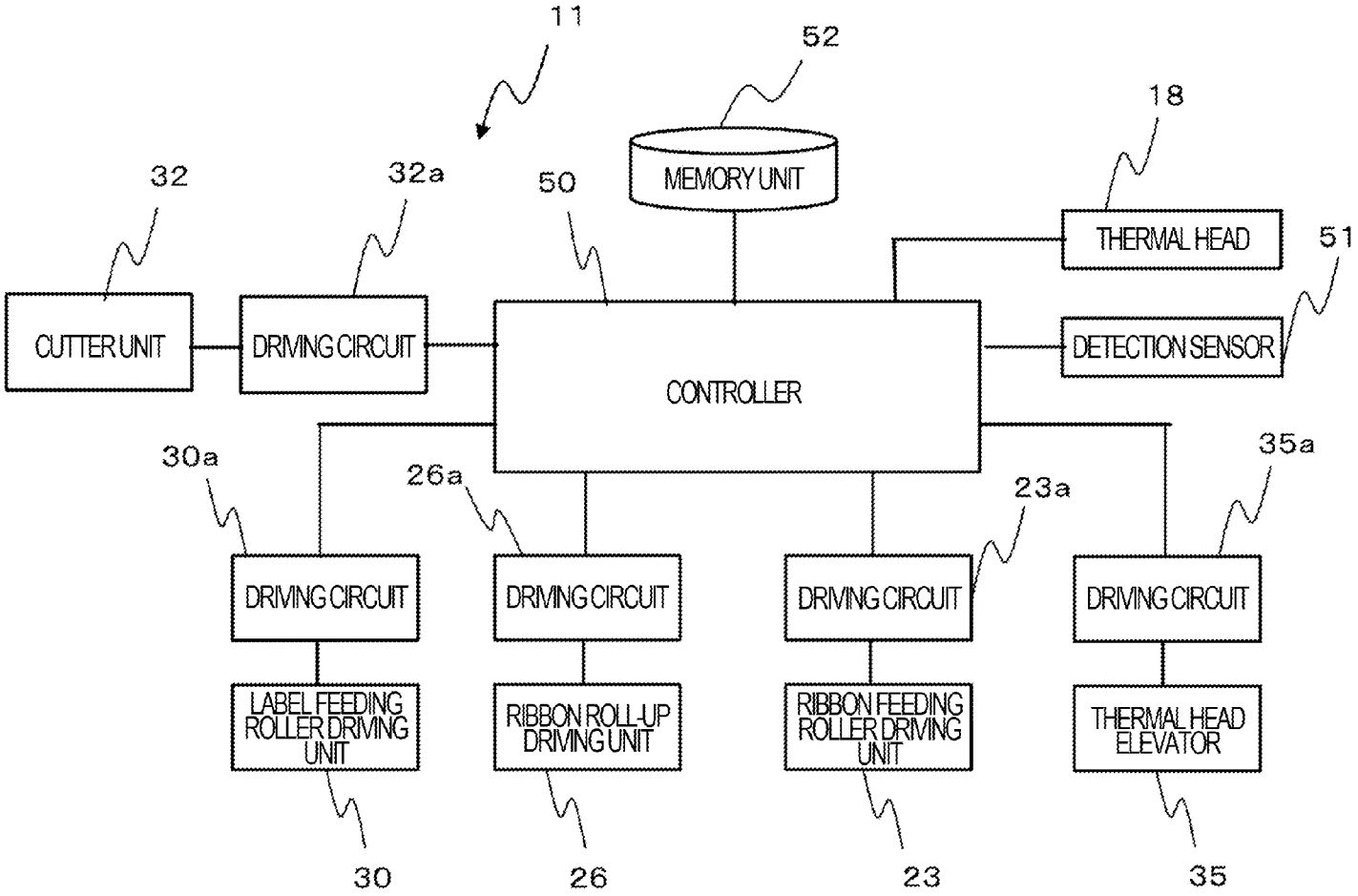
FIG. 2 is a block diagram illustrating a control system of the thermal transfer printer.

FIG. 2 is a block diagram illustrating a control system including the ribbon feeding roller driving unit 23, the ribbon roll-up driving unit 26, the label feeding roller driving unit 30, the thermal head elevator 35, the cutter unit 32, the thermal head 18, and the controller 50 connected to these components.

Referring to FIG. 2, the thermal transfer printer 11 has the controller 50 consisting of a computer unit (such as a central processing unit (CPU)). The controller 50 is controllably connected to the ribbon feeding roller driving unit 23, the ribbon roll-up driving unit 26, the label feeding roller driving unit 30, the thermal head elevator 35, and the cutter unit 32 through driving circuits 23*a*, 26*a*, 30*a*, 35*a*, and 32*a*, respectively.

The driving circuits 23*a*, 26*a*, 30*a*, 35*a*, and 32*a* supply electric power to the ribbon feeding roller driving unit 23, the ribbon roll-up driving unit 26, the label feeding roller driving unit 30, the thermal head elevator 35, and the cutter unit 32, respectively, in order to drive each of them in response to a control signal from the controller 50.

The controller 50 is also connected to the detection sensor 51 for detecting a position detection mark (not shown) provided on the label piece or the liner sheet included in the continuous label sheet 16 and the thermal head 18 that performs printing on a predetermined position of the label piece depending on the detection result of the detection sensor 51.

The controller 50 controls a print timing or the like on the basis of the position detection mark detected by the detection sensor 51 in order to allow the thermal head 18 to perform printing on a predetermined position (print position) of the label piece.

A memory unit 52 (such as a hard disk or a flash memory) is connected to the controller 50. The memory unit 52 stores programs such as a sequence for performing printing on the continuous label sheet 16 using the thermal transfer printer 11 or a program for maintenance of the thermal transfer printer 11.

Subsequently, an operational sequence of the thermal transfer printer 11 (for forward and backward feeding) will be described with reference to the flowchart of FIG. 3 and the timing chart of FIG. 4. Note that the configuration of the apparatus of FIG. 1 and the control system of FIG. 2 will be appropriately referenced in the description of the operational sequence.

Figure 3:
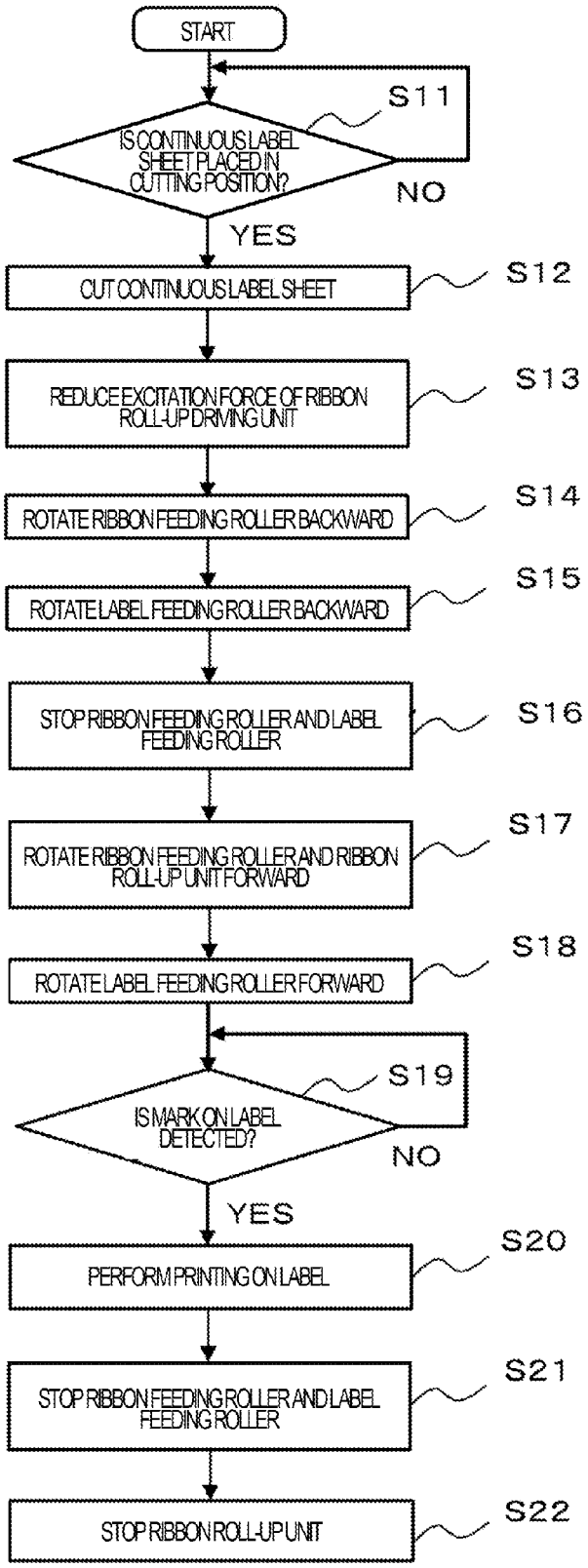
FIG. 3 is a flowchart illustrating operations (for forward feeding and backward feeding) of the thermal transfer printer.

Referring to FIG. 3, the controller 50 determines whether or not the continuous label sheet 16 subjected to printing on the label piece is fed to a predetermined position (cutting position) of the cutter unit 32 (in step S11).

If the continuous label sheet 16 subjected to the printing is fed to the cutter unit 32 (YES in S11), the controller 50 allows the cutter unit 32 to cut the continuous label sheet 16 at the predetermined position and separates the printed label piece (along with the attached liner sheet) from the continuous label sheet 16 (in step S12, cutting/peeling control means). If the continuous label sheet 16 subjected to the printing does not reach the cutter unit 32 (NO in step S11), the controller 50 keeps the cutter unit 32 in a standby state.

If the printed label piece is cut out by the cutter unit 32, a remaining unprinted portion of the continuous label sheet 16 is reversely fed to the thermal head 18 side (opposite to the cutter unit 32) by a predetermined distance in order to move the label piece to a predetermined print position. The controller 50 reduces an excitation force of the ribbon roll-up driving unit 26 (motor) using the driving circuit 26*a* (in step S13, backward feeding control means) at the timing T1 in FIG. 4. By reducing the excitation force (for example, by lowering the electric current from 2 A approximately to 0.5 A), a roll-up force of the ink ribbon 12 is reduced, so that the ink ribbon can be fed backward as described below.

Figure 4:
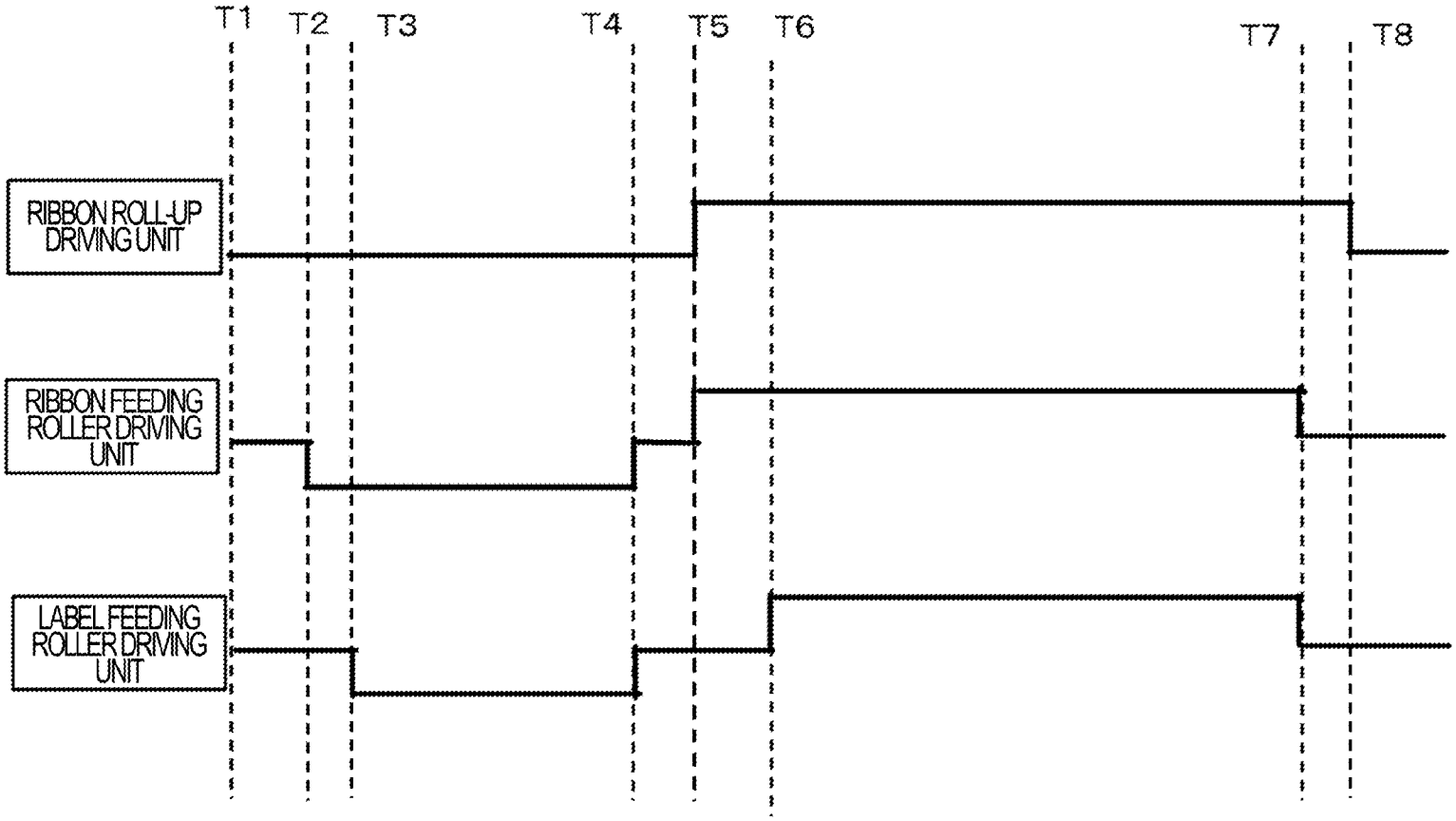
FIG. 4 is a timing chart illustrating operations (for forward feeding and backward feeding) of the thermal transfer printer.

After the excitation force of the ribbon roll-up driving unit 26 (motor) is reduced, the controller 50 reversely rotates the ribbon feeding rollers 21 and 22 using the ribbon feeding roller driving unit 23, so that the ink ribbon 12 is fed backward oppositely to the roll-up direction (in step S14, backward feeding control means) at the timing T2 in FIG. 4.

As a result, the ink ribbon 12 between the first ribbon feeding roller 21 and the platen roller 19 is loosened, and loosening of the ink ribbon 12 between the second ribbon feeding roller 22 and the platen roller 19 is removed. Since the ribbon feeding rollers 21 and 22 are rotated to feed the ink ribbon 12 while the ink ribbon 12 is held on the adhesive layers 21*a* and 22*a* on their surfaces, it is possible to accurately control a feeding amount on the basis of behaviors of the ribbon feeding rollers 21 and 22 such as the rotation number, the rotation angle, and the angular velocity regardless of a change of the roll-up diameter. Therefore, it is possible to remove or adjust loosening of the ink ribbon 12 within a predetermined range.

After starting the backward feeding of the ribbon feeding rollers 21 and 22 at the timing T2 in FIG. 4, the controller 50 rotates the label feeding roller 28 and the platen roller 19 backward using the label feeding roller driving unit 30 at the timing T3 in FIG. 4, so that the continuous label sheet 16 is fed backward (oppositely to the cutter unit 32) (in step S15, backward feeding control means). Since loosening of the ink ribbon between the second ribbon feeding roller 22 and the platen roller 19 is removed as described above, it is possible to prevent a surface stain caused by scraping between the ink ribbon 12 and the continuous label sheet 16 in the backward feeding after cutting of the continuous label sheet 16.

The controller 50 stops the ribbon feeding rollers 21 and 22 and the label feeding roller 28 (including the platen roller 19) using the ribbon feeding roller driving unit 23 and the label feeding roller driving unit 30 after a predetermined time (at the timing T4 in FIG. 4) from the start of the backward feeding (in step S16, backward feeding stop control means), so that the backward feeding stops.

Next, forward feeding in which the continuous label sheet 16 is fed in the roll-up direction after stopping the backward feeding will be described.

The controller 50 simultaneously activates the ribbon feeding roller driving unit 23 and the ribbon roll-up driving unit 26 to rotate the ribbon feeding rollers 21 and 22 and the ribbon roll-up unit 15 (forward) in order to feed the ink ribbon 12 toward the ribbon roll-up unit 15 (in step S17, feeding control means) at the timing T5 in FIG. 4.

As a result, loosening of the ink ribbon 12 between the first ribbon feeding roller 21 and the platen roller 19 is removed, and the amount of the ink ribbon fed to the platen roller 19 from the second ribbon feeding roller 22 is appropriately controlled.

After the ribbon feeding roller driving unit 23 and the ribbon roll-up driving unit 26 are simultaneously activated, the controller 50 activates the label feeding roller driving unit 30 (at the timing T6 in FIG. 4) to rotate the label feeding roller 28 (including the platen roller 19) forward and feed the continuous label sheet 16 toward the cutter unit 32 (forward feeding) (in step S18, feeding control means).

Since loosening of the ink ribbon 12 between the first ribbon feeding roller 21 and the platen roller 19 is removed, and the amount of the ink ribbon fed to the platen roller 19 from the second ribbon feeding roller 22 is appropriately controlled as described above, it is possible to suppress scraping between the continuous label sheet 16 and the ink ribbon 12 and prevent a surface stain.

The controller 50 determines whether or not the position detection mark (not shown) provided on the label piece or the liner sheet of the continuous label sheet 16 is detected by the detection sensor 51 (in step S19). If the position detection mark is detected, the controller 50 performs printing on the label piece using the thermal head 18 that nips the continuous label sheet 16 in combination with the platen roller 19 (in step S20, print control means). If the position detection mark is not detected (NO in step S19), the controller 50 keeps the thermal head 18 in a print standby state.

After printing on the label piece is completed, the controller 50 stops the ribbon feeding rollers 21 and 22 and the label feeding roller 28 (including the platen roller 19) using the ribbon feeding roller driving unit 23 and the label feeding roller driving unit 30 at the same time (in step S21, stop control means) (at the timing T7 in FIG. 4). Then, at the timing T8 in FIG. 4, the controller 50 stops rotation of the ribbon roll-up unit 15 using the ribbon roll-up driving unit 26 (in step S22, stop control unit).

In this manner, the ribbon roll-up unit 15 stops after the ribbon feeding rollers 21 and 22 and the label feeding roller 28 (including the platen roller 19) stop. Therefore, it is possible to sufficiently roll up the ink ribbon 12 and suppress loosening of the ink ribbon 12.

As described above, according to this embodiment, in the forward feeding and the backward feeding performed after cutting of the label piece, it is possible to accurately control the amount of the ink ribbon 12 fed by the first ribbon feeding roller 21 and the second ribbon feeding roller 22. Therefore, it is possible to suppress loosening of the ink ribbon 12. As a result, it is possible to suppress scraping between the ink ribbon and the continuous label sheet 16 and prevent a surface stain or the like.

In addition, the ink ribbon 12 is appropriately tensioned by the first and second ribbon feeding rollers 21 and 22 with respect to the thermal head 18, it is also possible to prevent a wrinkle in the ink ribbon 12 caused by deviated printing.

Next, an operational sequence of the thermal transfer printer 11 (for a ribbon save function) will be described with reference to the flowchart of FIG. 5 and the timing chart of FIG. 6. Note that the configuration of the apparatus of FIG. 1 and the control system of FIG. 2 will be appropriately referenced in the description of the operational sequence. In addition, the aforementioned operations (for forward feeding and backward feeding) will not be repeatedly described for simplicity purposes.

Figure 5:
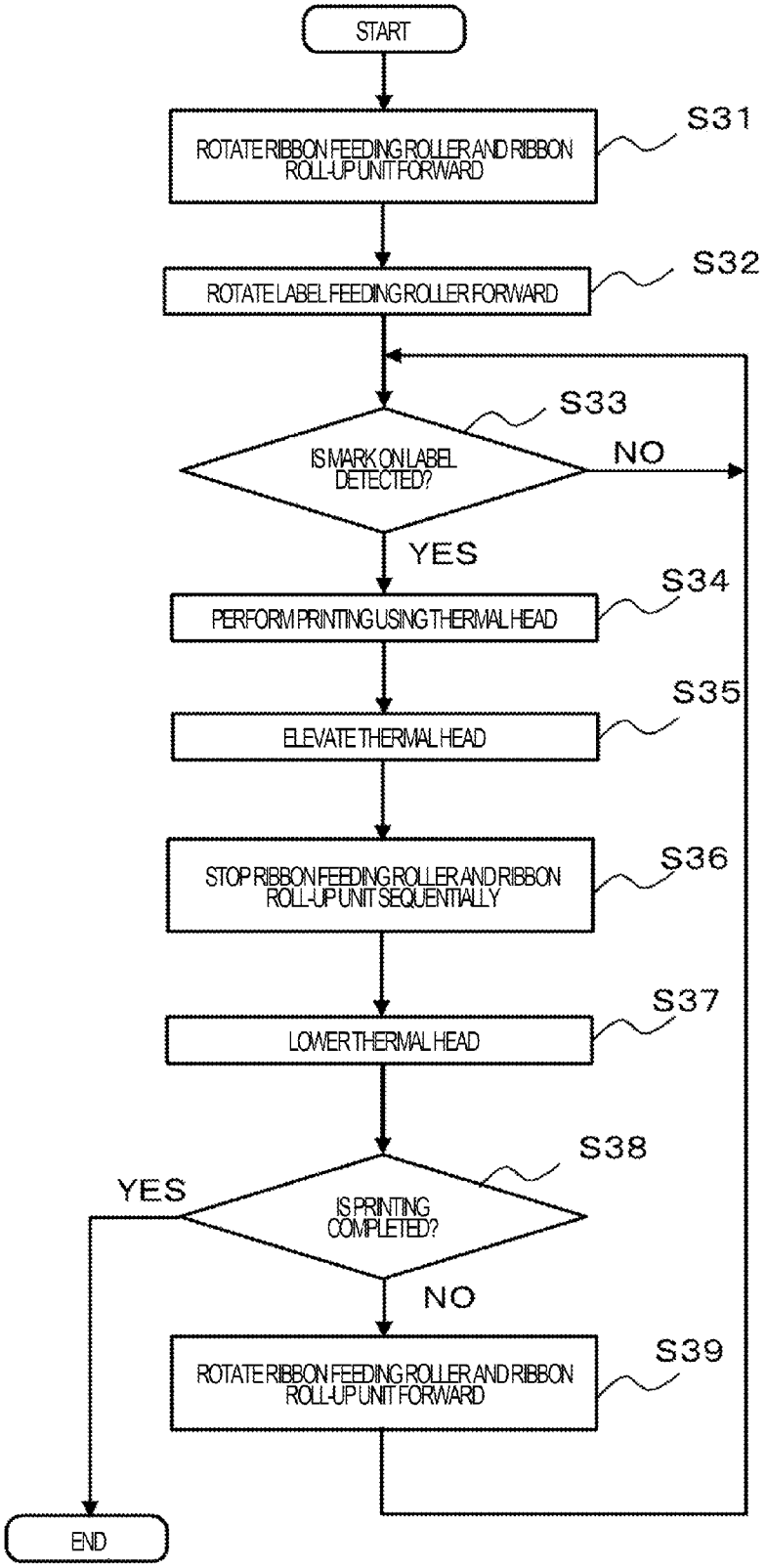
FIG. 5 is a flowchart illustrating an (ribbon save) operation of the thermal transfer printer.
Figure 6:
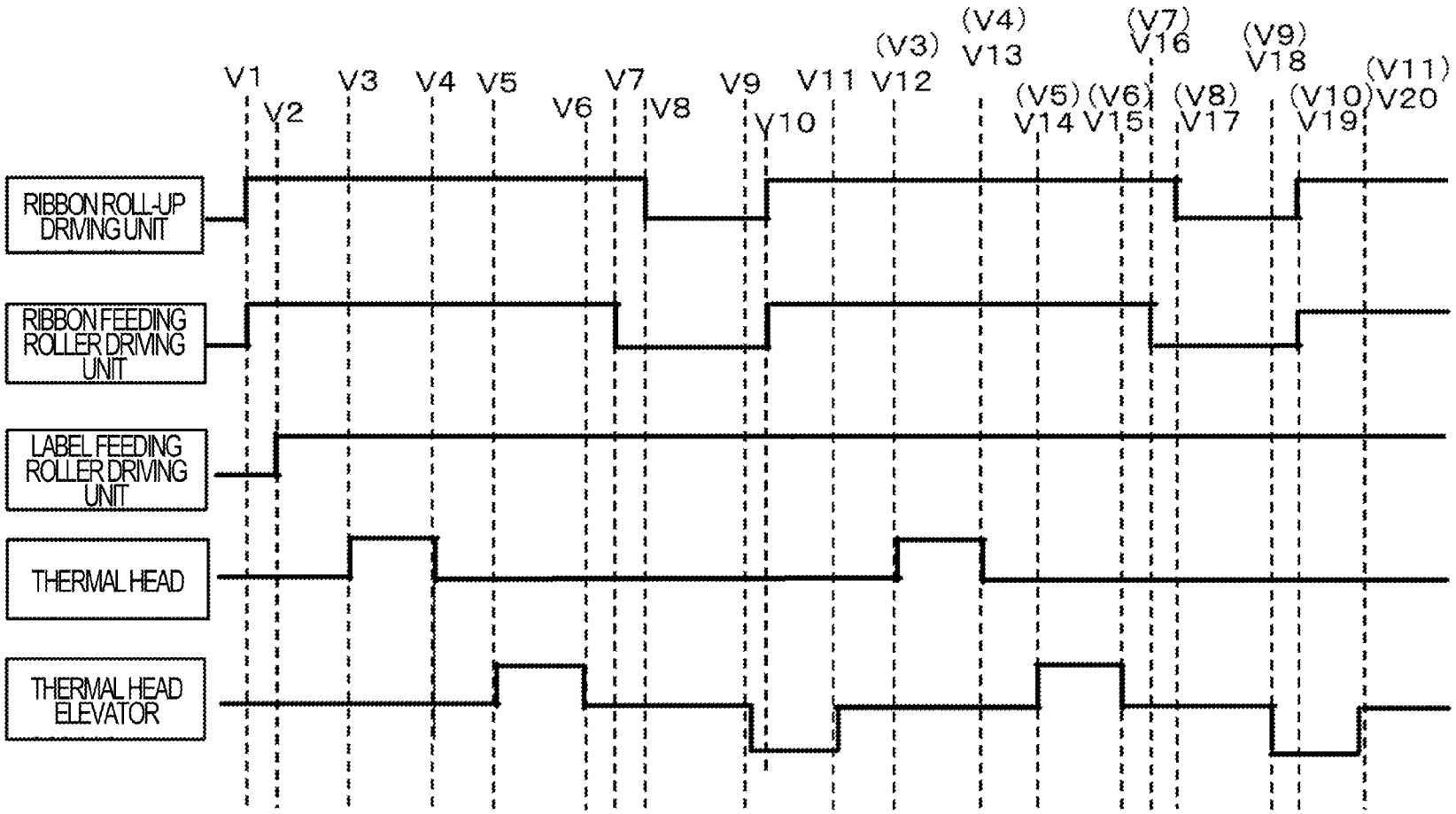
FIG. 6 is a timing chart illustrating the (ribbon save) operation of the thermal transfer printer.

Referring to FIG. 5, the controller 50 activates the ribbon roll-up driving unit 26 and the ribbon feeding roller driving unit 23 to start forward rotation of the ribbon roll-up unit 15 and the ribbon feeding rollers 21 and 22 in order to feed the ink ribbon 12 in the ribbon roll-up direction (in step S31, feeding control means) at the timing V1 in FIG. 6.

As a result, loosening of the ink ribbon 12 between the first ribbon feeding roller 21 and the platen roller 19 is removed, and the second ribbon feeding roller 22 feeds the ink ribbon 12 toward the platen roller 19. Therefore, it is possible to suppress scraping between the continuous label sheet 16 and the ink ribbon 12 and prevent a surface stain.

After the start of forward rotation of the ribbon roll-up unit 15 and the ribbon feeding rollers 21 and 22, the controller 50 rotates the label feeding roller 28 (platen roller 19) forward using the label feeding roller driving unit 30 in order to feed the continuous label sheet 16 toward the cutter unit 32 (in step S32, feeding control means) (at the timing V2 in FIG. 6).

If the detection sensor 51 (refer to FIG. 2) detects the position detection mark (not shown) provided on the label piece or the liner sheet of the fed continuous label sheet 16 (YES in step S33), the controller 50 performs printing on a predetermined position (print position) of the label using the thermal head 18 (in step S34, print control means) at the timing V3 to V4 in FIG. 6. If the position detection mark is not detected, the controller 50 keeps the thermal head 18 in a standby state until the position detection mark is detected (NO in step S33).

After the printing on the label is completed, the controller 50 operates the thermal head elevator 35 to elevate the thermal head 18 in order to exert the ink ribbon save function (in step S35, elevation control means).

As the thermal head elevator 35 is operated, elevation of the thermal head 18 starts at the timing V5 in FIG. 6, and the thermal head 18 is elevated up to a predetermined position at the timing V6 in FIG. 6. As the thermal head 18 is elevated, nipping of the ink ribbon 12 and the continuous label sheet 16 between the thermal head 18 and the platen roller 19 is released, and the ink ribbon 12 and the continuous label sheet 16 are separated from each other.

After the thermal head 18 is elevated to a predetermined position at the timing V6 in FIG. 6, the controller 50 stops the ribbon feeding rollers 21 and 22 at the timing V7 in FIG. 6 and stops the ribbon roll-up unit 15 at the timing V8 in FIG. 6 (in step S36, ribbon feeding stop control means).

The ribbon feeding rollers 21 and 22 feed the ink ribbon 12 while the ink ribbon 12 makes contact with the adhesive layers 21*a* and 22*a*, respectively, on their surfaces. For this reason, the ink ribbon 12 is fed while it is held on the surfaces of the adhesive layers 21*a* and 22*a*. Since the feeding amount of the ink ribbon 12 can be accurately controlled by controlling the rotation of the feeding rollers 21 and 22, it is possible to adjust the amount of the saved ink ribbon by adjusting the stop timings (the timing V7 in FIG. 6) of the ribbon feeding rollers 21 and 22.

In the prior art, the feeding amount of the ink ribbon 12 is controlled using the ribbon roll-up roller. However, since the diameter of the ribbon wound around the roll-up roller changes during the roll-up operation, it is difficult to accurately control the ribbon save function. According to this embodiment, as described above, the feeding amount of the ink ribbon 12 can be controlled by rotating the ribbon feeding rollers 21 and 22 regardless of a change of the winding diameter of the ink ribbon 12. Therefore, it is possible to suppress loosening of the ink ribbon 12 and accurately control the amount of the saved ink ribbon 12.

Then, the controller 50 drives the thermal head elevator 35 to lower the thermal head 18 in order to further perform printing (in step S37) at the timings V9 to V11 in FIG. 6 (from the start of lowering to the end of lowering). If the printing on the label is completed (YES in step S38), the thermal head 18 is lowered to the print position, and the process is terminated.

If the printing on the label is continuously performed (NO in step S38), the ribbon roll-up driving unit 26 and the ribbon feeding roller driving unit 23 are operated to start forward rotation of the ribbon roll-up unit 15 and the ribbon feeding rollers 21 and 22 during lowering of the thermal head 18 at the timing V9 in FIG. 6 (in step S39) in order to feed the ink ribbon 12 in the ribbon roll-up direction to start the next printing work.

Then, the operations described above are repeated (in FIG. 6, the timings V3, V4, V5, V6 V7, V8, V9, V10, and V11 correspond to the timings V12, V13, V14, V15, V16, V17, V18, V19, and V20, respectively).

As described above, the feeding amount of the ink ribbon 12 can be accurately controlled using the ribbon feeding rollers 21 and 22 regardless of the winding diameter of the ink ribbon 12. Therefore, it is possible to suppress loosening of the ink ribbon 12 and accurately control the amount of the saved ink ribbon.

Second Embodiment

Next, a thermal transfer printer 70 according to a second embodiment of the present invention will be described with reference to FIG. 7. In the following description, like reference numerals denote like elements as in the first embodiment. In addition, the elements similar to those of the first embodiment will not be repeatedly described for simplicity purposes.

Figure 7:
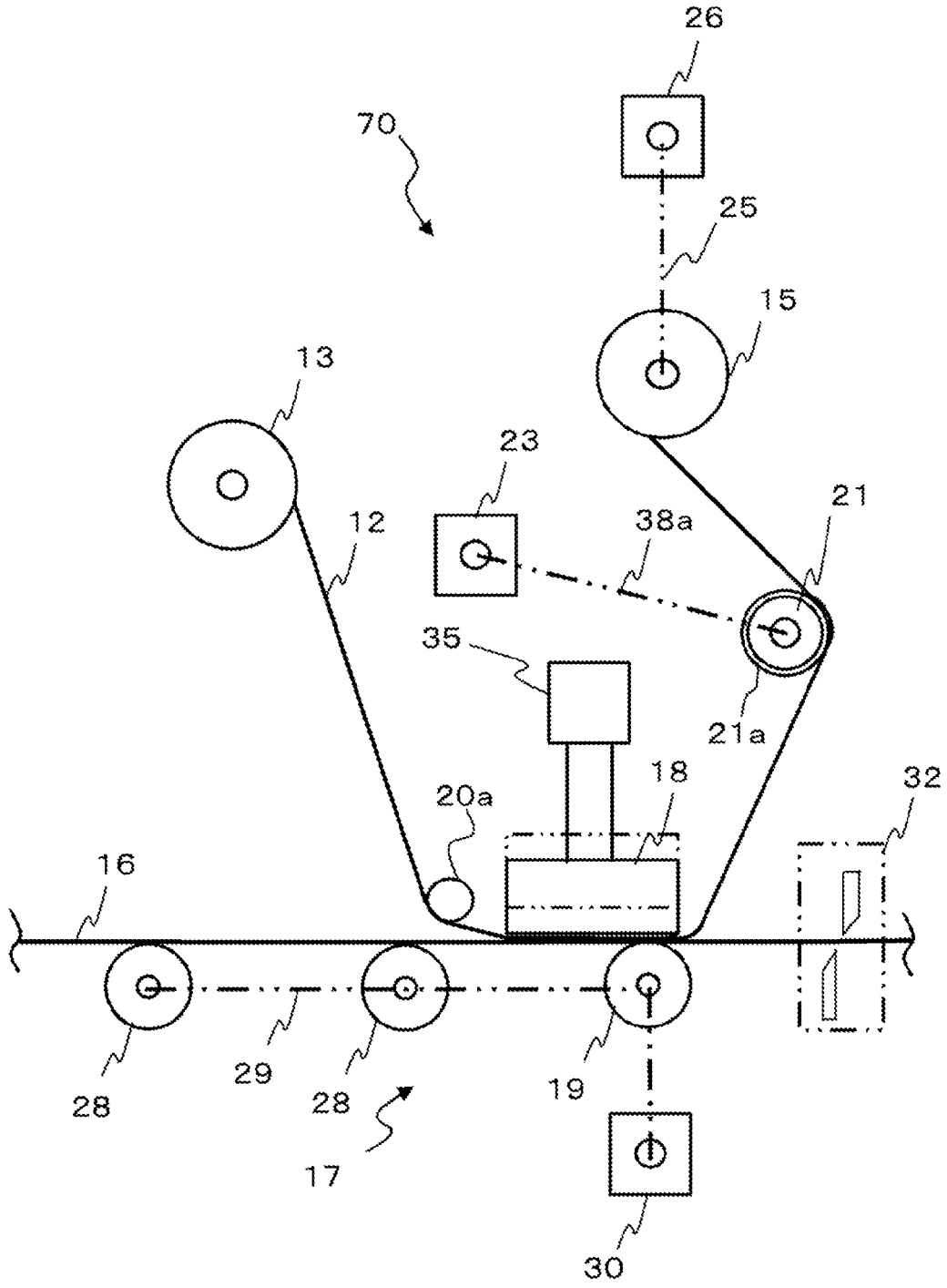
FIG. 7 is a schematic diagram illustrating a thermal transfer printer according to a second embodiment of the invention.

In the thermal transfer printer 70 illustrated in FIG. 7, an ink ribbon feeding roller is provided only in the downstream side of the thermal head 18 in the feeding direction of the ink ribbon 12. That is, a second ribbon feeding roller 22 is removed from the thermal transfer printer 11, and only the first ribbon feeding roller 21 is provided as a ribbon feeding roller. Note that a tension roller 20*a* is provided between the thermal head 18 and the ribbon feeding unit 13 in order to tension the ink ribbon 12.

According to this embodiment, when the ink ribbon 12 is fed forward, the feeding amount of the ink ribbon 12 is accurately controlled by simultaneously rotating the ribbon roll-up unit 15 and the ribbon feeding roller 21 (forward), so that it is possible to remove loosening of the ink ribbon 12 between the platen roller 19 and the first ribbon feeding roller 21.

As a result, it is possible to prevent a surface stain that may be generated during forward feeding. In addition, it is possible to more accurately exert the ink ribbon save function by controlling the feeding amount using the first ribbon feeding roller 21 relative to the method of the prior art in which the roll-up roller is controlled.

Since the second ribbon feeding roller 22 is not provided in this embodiment, loosening of the ink ribbon between the thermal head 18 and the ribbon feeding unit 13 may not be sufficiently removed during backward feeding relative to the first embodiment. However, even in this case, it is possible to more accurately control the feeding amount of the ink ribbon 12 relative to the method of the prior art in which the roll-up roller or the like influenced by a change of the diameter is used to control the feeding amount.

Third Embodiment

Next, a thermal transfer printer 80 according to a third embodiment of the present invention will be described with reference to FIG. 8. In the following description, like reference numerals denote like elements as in the first embodiment. In addition, the elements similar to those of the first embodiment will not be repeatedly described for simplicity purposes.

Figure 8:
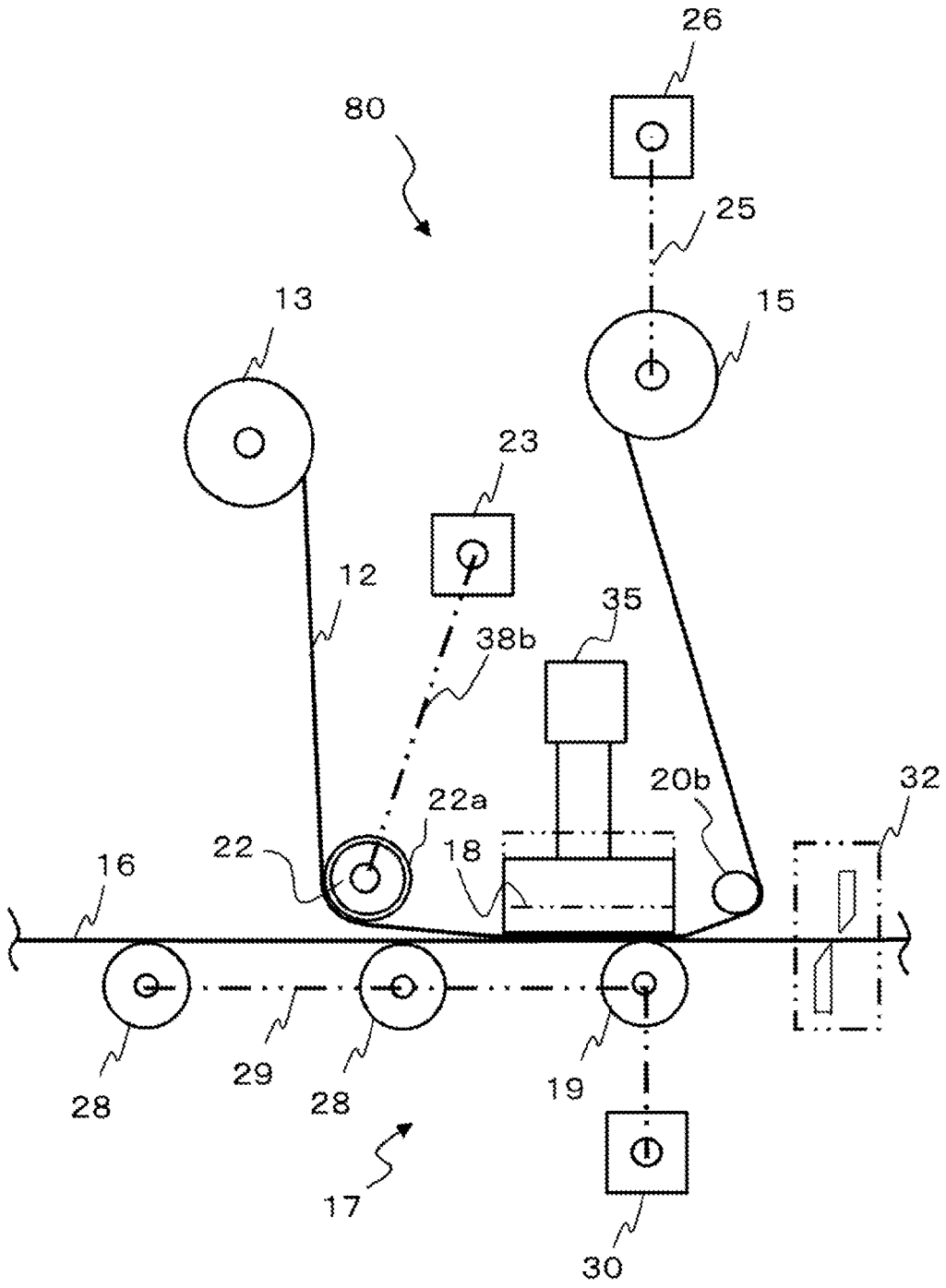
FIG. 8 is a schematic diagram illustrating a thermal transfer printer according to a third embodiment of the invention.

In the thermal transfer printer 80 according to the third embodiment as illustrated in FIG. 8, an ink ribbon feeding roller is provided only in the upstream side of the thermal head 18 in the feeding direction of the ink ribbon 12. That is, the first ribbon feeding roller 21 is removed from the thermal transfer printer 11, and only the second ribbon feeding roller 22 is provided as the ribbon feeding roller. Note that a tension roller 20*b* is provided between the thermal head 18 and the ribbon roll-up unit 15 in order to tension the ink ribbon 12.

According to this embodiment, when the ink ribbon 12 is fed backward, the excitation force of the ribbon roll-up driving unit 26 (motor) is reduced, and the ink ribbon 12 is then fed (backward) reversely to the roll-up direction of the ink ribbon 12 by reversely rotating the ribbon feeding roller 22 using the ribbon feeding roller driving unit 23 in order to loosen the ink ribbon 12 between the ribbon roll-up unit 15 and the platen roller 19 and remove loosening of the ink ribbon 12 between the second ribbon feeding roller 22 and the platen roller 19.

Using the ribbon feeding roller 22, it is possible to feed the ink ribbon 12 while the ink ribbon 12 is held on the adhesive layer 22*a* on a surface of the ribbon feeding roller 22. Therefore, it is possible to accurately control the feeding amount on the basis of a behavior of the ribbon feeding roller 22 such as the rotation number, the rotation angle, and the angular velocity regardless of a change of the winding diameter. As a result, it is possible to remove or adjust loosening of the ink ribbon 12 and prevent a surface stain that may be generated during backward feeding.

The third embodiment is different from the first embodiment in that the first ribbon feeding roller 21 is not provided. However, in terms of both the forward feeding and the ink ribbon save function, it is possible to more accurately control the feeding amount of the ink ribbon 12 relative to the method of the prior art in which a roll-up roller or the like influenced by a change of the diameter is used to control the feeding amount.

Although embodiments of this invention have been described hereinbefore, the aforementioned embodiments are just a part of applications of this invention, and are not intended to limit the technical scope of this invention to specific configurations of the aforementioned embodiments.

This application is based on and claims priority to Japanese Patent Application Laid-open No. 2014-112146 (filed in Japan Patent Office on May 30, 2014), the entire content of which is incorporated herein by reference.

The invention claimed is:

1. A thermal transfer printer configured to print by nipping a print medium fed by a feeding mechanism and an ink ribbon fed from a ribbon feeding unit and rolled up by a ribbon roll-up unit between a platen roller and a thermal head, and transferring ink from the ink ribbon onto a print surface of the print medium using the thermal head, the thermal transfer printer comprising:

a label feeding roller driving unit configured to drive the feeding mechanism;

a ribbon roll-up driving unit configured to drive the ribbon roll-up unit;

at least one ribbon feeding roller provided in at least one of a first position between the thermal head and the ribbon roll-up unit or a second position between the thermal head and the ribbon feeding unit; and a ribbon feeding roller driving unit configured to drive the at least one ribbon feeding roller, wherein the at least one ribbon feeding roller has an adhesive layer on its surface and is configured to feed the ink ribbon by being rotated while holding the ink ribbon on the adhesive layer, the thermal transfer printer is configured to perform a print control by printing on the print medium by transferring the ink from the ink ribbon using the thermal head, and the thermal transfer printer is configured to perform a stop control, after performing the print control, by stopping feeding of the print medium in the feeding mechanism and by stopping feeding of the ink ribbon at the at least one ribbon feeding roller, simultaneously, and subsequently by stopping an ink ribbon roll-up operation in the ribbon roll-up unit.

2. The thermal transfer printer according to claim 1, wherein the surface of the at least one ribbon feeding roller is an adhesive sheet body.

3. The thermal transfer printer according to claim 2, wherein the adhesive layer of the at least one ribbon feeding roller comprises the adhesive sheet body on a cylindrical roller, and the adhesive sheet body includes a first layer comprising silicone, a second layer comprising glass cloth, and a third layer comprising a silicone adhesive layer.

4. The thermal transfer printer according to claim 1, wherein the thermal transfer printer is configured to perform a feeding control, before performing the print control, by starting the feeding of the ink ribbon using the at least one ribbon feeding roller and by starting the ink ribbon roll-up operation in the ribbon roll-up unit, simultaneously, and subsequently by starting the feeding of the print medium using the feeding mechanism.

5. The thermal transfer printer according to claim 1, further comprising:

a print medium cutter or peeler unit configured to cut or peel the print medium, wherein the at least one ribbon feeding roller is provided in the second position, the thermal transfer printer is configured to perform a cutting/peeling control by cutting or peeling a predetermined portion of the print medium using the print medium cutter or peeler unit, the predetermined portion of the print medium being printed on by transferring the ink from the ink ribbon using the thermal head, the thermal transfer printer is configured to perform a backward feeding control by reducing a roll-up force ribbon roll-up unit and by feeding the ink ribbon toward the ribbon feeding unit using the at least one ribbon feeding roller in the second position after cutting or peeling the print medium, and subsequently by feeding a part of the print medium remaining after cutting or peeling the predetermined portion of the print medium toward a predetermined position opposite to the cutter or peeler unit using the feeding mechanism, and the thermal transfer printer is configured to perform a backward feeding stop control by stopping the feeding of the ink ribbon by the at least one ribbon feeding roller in the second position and by stopping the feeding of the print medium by the feeding mechanism when the print medium reaches the predetermined position.

6. The thermal transfer printer according to claim 1, wherein a plurality of ribbon feeding rollers are provided in the first position and the second position, and the ribbon feeding roller driving unit drives the plurality of ribbon feeding rollers in the first position and the second position in synchronization with each other.

7. The thermal transfer printer according to claim 1, further comprising a thermal head elevator mechanism configured to elevate or lower the thermal head, wherein the thermal transfer printer is configured to perform an elevation control by controlling elevation or lowering of the thermal head elevator mechanism, the thermal transfer printer is configured to perform a ribbon feeding stop control by stopping the feeding of the ink ribbon at the at least one ribbon feeding roller after elevating the thermal head, and subsequently by stopping the ink ribbon roll-up operation in the ribbon roll-up unit, and the thermal transfer printer is configured to perform a ribbon feeding driving control by driving the ribbon roll-up unit and the at least one ribbon feeding roller during lowering of the thermal head by the elevation control.

* * * * *